US005135231A

United States Patent [19]

Piper

[11] Patent Number: 5,135,231

[45] Date of Patent: Aug. 4, 1992

[54] GEOGRAPHICAL BOARD GAME

[76] Inventor: John R. Piper, 4 Highland Pl., Clifton Springs, N.Y. 14432

[21] Appl. No.: 746,980

[22] Filed: Aug. 19, 1991

[51] Int. Cl.[5] ..... A63F 3/04

[52] U.S. Cl. ..... 273/254; 273/146

[58] Field of Search ..... 273/251, 252, 254, 146

[56] References Cited

U.S. PATENT DOCUMENTS

| | | | |
|---|---|---|---|
| 1,613,526 | 1/1927 | Nedds . | |
| 2,831,690 | 4/1958 | Seay | 273/254 |
| 3,799,551 | 3/1974 | Erickson | 273/134 |
| 3,947,038 | 3/1976 | Archer | 273/254 |
| 4,049,276 | 9/1977 | Hole | 273/134 |
| 4,061,336 | 12/1977 | Lincoln | 273/134 |
| 4,070,026 | 1/1978 | Cambardella | 273/254 |
| 4,082,284 | 4/1978 | Jennings | 273/251 |
| 4,290,607 | 9/1981 | McDonald | 273/239 |
| 4,426,084 | 1/1984 | Michel | 273/254 |
| 4,678,191 | 7/1987 | Mills et al. | 273/146 |
| 4,834,389 | 5/1989 | Coffman | 273/252 |
| 4,932,665 | 6/1990 | Fejdasz et al. | 273/146 X |
| 5,085,441 | 2/1992 | Jova | 273/146 X |

FOREIGN PATENT DOCUMENTS

| | | | |
|---|---|---|---|
| 1187095 | 4/1970 | United Kingdom | 273/146 |
| 2199504 | 7/1988 | United Kingdom | 273/146 |

*Primary Examiner*—William H. Grieb
*Assistant Examiner*—William E. Stoll
*Attorney, Agent, or Firm*—Cumpston & Shaw

[57] ABSTRACT

A game apparatus which includes a game board providing a playing area which simulates the geographical area of the United States with each of the 50 states outlined and identified. Each of the states contain one or more pairs of directional arrows for travel for a game piece. A plurality of identifiable playing pieces are used which are intended to be moved from state to state. One game piece is assigned to and moved by each individual player upon a roll of specially designed dice in a north, south, east or west direction in response to the reading of the dice.

6 Claims, 3 Drawing Sheets

GEOGRAPHICAL BOARD GAME

BACKGROUND OF THE INVENTION

The present invention relates to a board game which contains a simulated map, and more specifically, to a board game designed to familiarize the user with the various 50 states of the United States. An additional benefit in playing the game of the present invention is also developing a feel or sense for the north, south, east and west directions on a board game or map by the way in which the various pieces involved in the game are moved.

A wide variety of board games using a simulated map of the United States are taught by the patent literature. Typical of such games are those shown in U.S. Pat. Nos. 1,613,526; 3,799,551; 4,049,276; 4,061,336; 4,070,026; 4,082,284; 4,290,607 and 4,834,389. There is, however, no teaching or suggestion of the concept of the present invention in any of the aforementioned patents.

SUMMARY OF THE INVENTION

An object of the present invention is to simulate travel over a game board through each of the 50 states of the United States through a game piece represented by a simulated vehicle in the form of an automobile, truck or the like. This objective is accomplished through rolling a pair of specially designed dice to obtain a number(s) and direction(s) which allow a player to move his game piece through each of the 50 states which are logged one by one on a log sheet for each player in the game. Each state on the map is provided with directional arrows which are either north, south, east or west depending the particular location of the states. Some states may only have one or two directions of travel depending upon their location within the United States, while other states may allow travel in each of the four directions. A player moves his game piece through each state by a roll of the dice which determines the amount of moves allowed a given player for each roll of the dice. As a player lands on or passes through each state, he receives credit in a travel log for a given state, and does not visit the state again, if possible, and goes from state to state until he has covered the entire 50 states of the United States. The first person to visit or pass through each of the 50 states is declared the winner of the game.

By playing the game, the player develops a knowledge of the geography of the United States including the name and geographical location of each state and a feel for the north, south, east, and west directions in passing through the geographical map of the game board.

Thus the game provides both a challenge from the standpoint of effectively passing through each of the 50 states, learning the names and locations of the various states, and the various directions on a map.

DETAILED DESCRIPTION OF THE INVENTION

Figure 1:
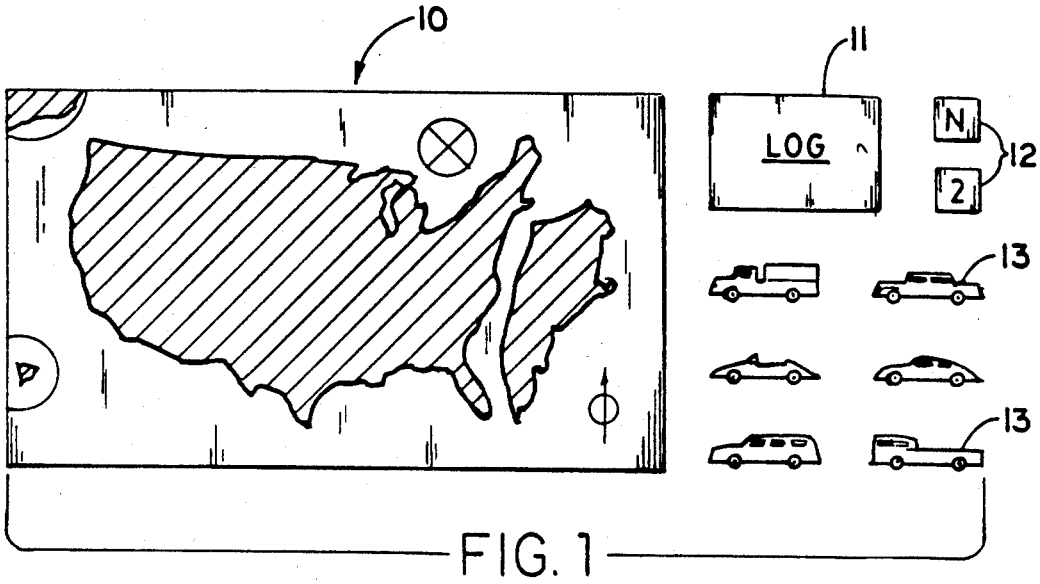
FIG. 1 is a plan view of the game board of the present invention schematically illustrating without detail the continental United States along with the various components of the game which includes a log sheet, two specialized dice and game pieces in the form of selected vehicles such as trucks and cars.

FIG. 1 illustrates a plan view of the game board 10 of the present invention and the various other component parts, of the present invention including a log 11 which includes the names of all 50 states. Two identical dice 12 are included and are more specifically illustrated in FIG. 2 in which each dice contains the letter designation for each of the north, south, east and west directions of the compass and the numerals 1 and 2. In addition, for purposes of illustration, six game pieces 13, one for each of six players, are illustrated in the form of vehicles such as automobiles and trucks.

Figure 3:
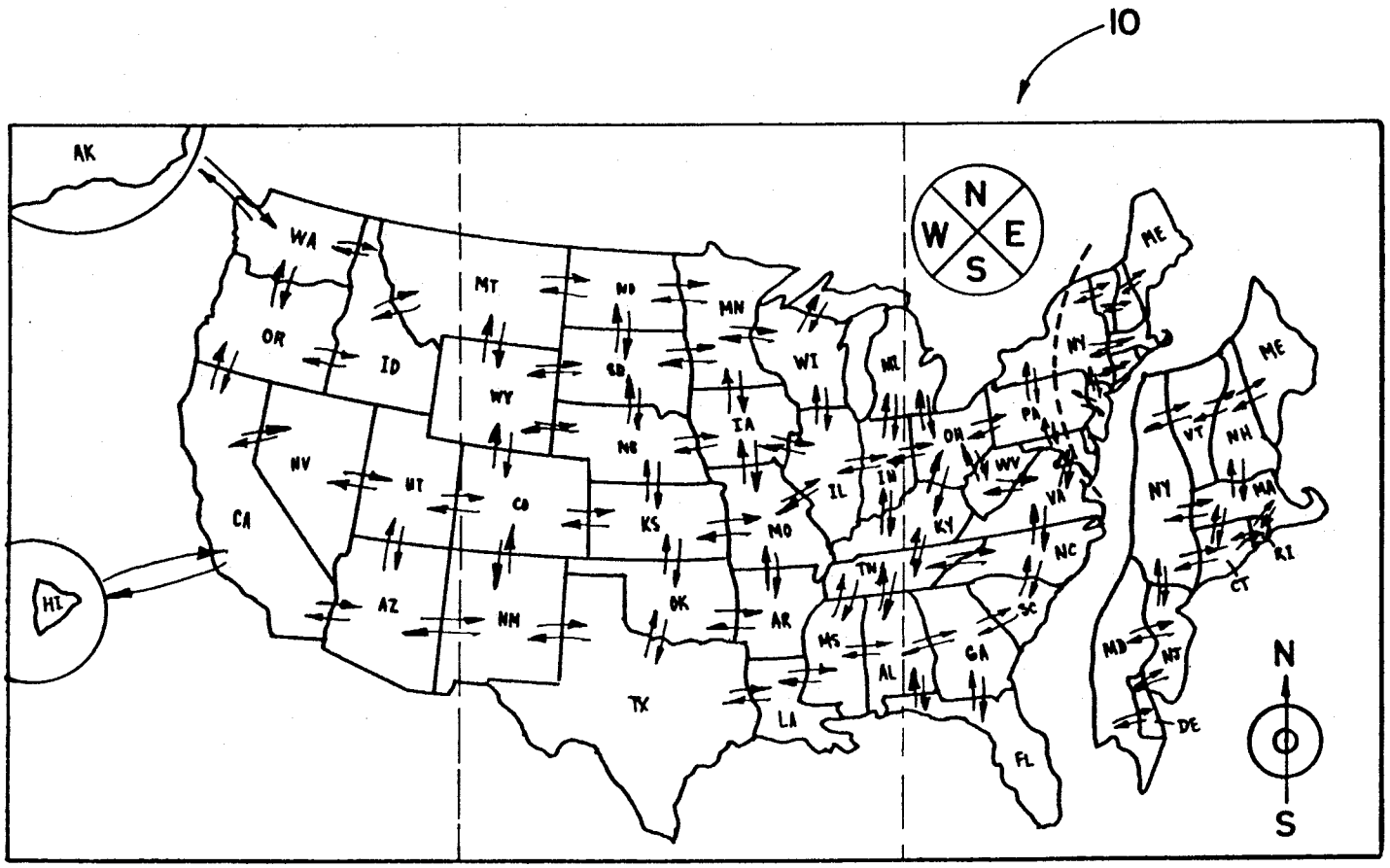
FIG. 3 illustrates an enlarged plan view of the game board of the present invention illustrating the geographic location of each state including directional arrows for each state which allow for given movement between each state during play.

FIG. 3 illustrates an enlarged view of the game board of FIG. 1 in which the permissible directional arrows for travel or movement of the game pieces during play are illustrated for each state, with each state specifically identified by its abbreviated name.

Figure 2:
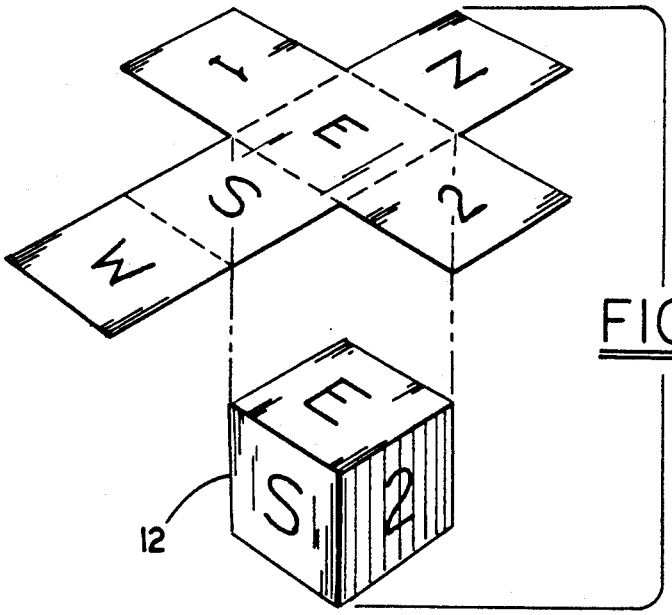
FIG. 2 represents one of two identical dice which contain on its six faces, each of the directions north, south, east and west indicated by the appropriate initial abbreviation N, S, E and W respectively, and the numbers 1 and 2.

The objective of the invention is to be the first player to land or pass through all 50 states. In operation the game is played as follows: All players start by placing their vehicle or game piece on the state in which the game is being played. Each player may cross off this state in their travel log. A person is selected to start the game by a roll of the dice. The player rolling the highest numerical total starts first. If there is a tie, the players tied roll the dice again until one player rolls the highest numerical total. Play then continues to the left as the players are seated around the board. The player chosen to go first rolls the dice. The dice 12 as illustrated in FIG. 2 are not normal playing dice and are marked with N, S, E, and W, and the numbers 1 and 2 as shown in FIG. 2. The N, S, E and W represent the directions north, south, east and west, respectively. When a direction is indicated on the dice it means that you can only travel in that direction. The numbers 1 and 2 represent a free move in any direction, with a 1 being one free move and 2 being two free moves. Each state has directional arrows going into one or more adjacent states. A player may only travel in the direction of the arrows from one state to another. For example, from Colorado you may go east into Kansas, but not into Nebraska as illustrated by the arrows on the map.

In one example of play, a player in New York rolls a 1, S. He could go south into Pennsylvania, and then may move in any direction with the arrows in his optional move for the 1. Alternatively, he could go into Massachusetts using the one free move first, then south into Connecticut. You may use either your free move or your directional dice move first. If, however, you have rolled an NN you must travel two moves north or as far as you can without going off the map. If you roll an NN and you are in Nebraska, you have to go through South Dakota to North Dakota even if you have already been through these two states. As you land on or pass through each state, it is crossed off on the travel log so that you don't visit that state again if it can be avoided. You may occupy a state that has another player's game piece on it, or a state that you have previously passed through. The board includes all 50 states with the northeast section of the country enlarged to make for easier play. (See FIG. 3.)

Figure 4:
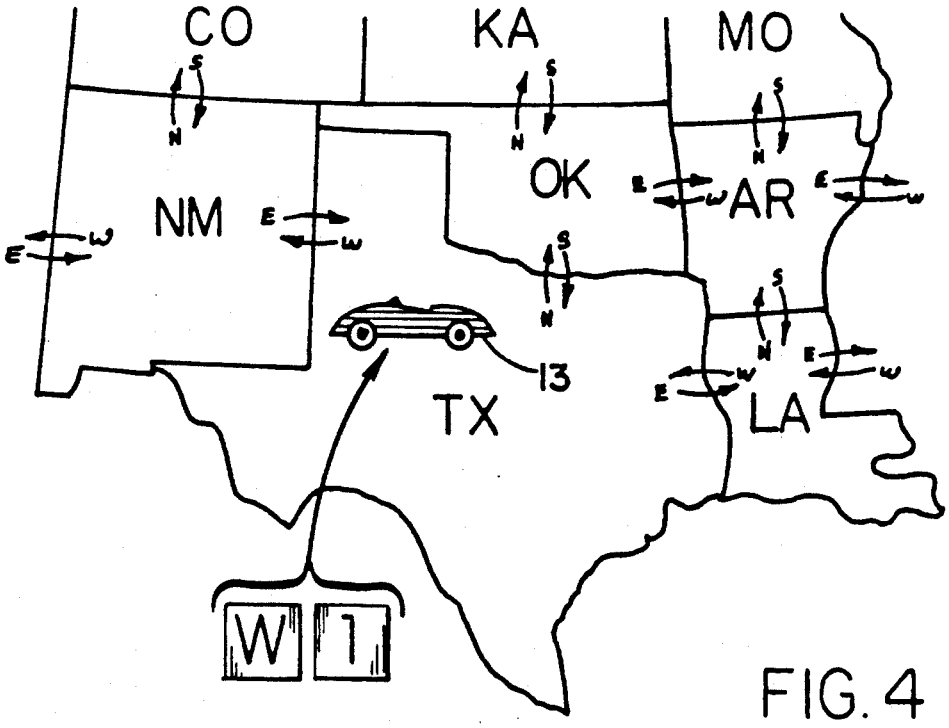
FIG. 4 illustrates an enlarged view of a section of southwestern states for a particular roll of the dice.
Figure 5:
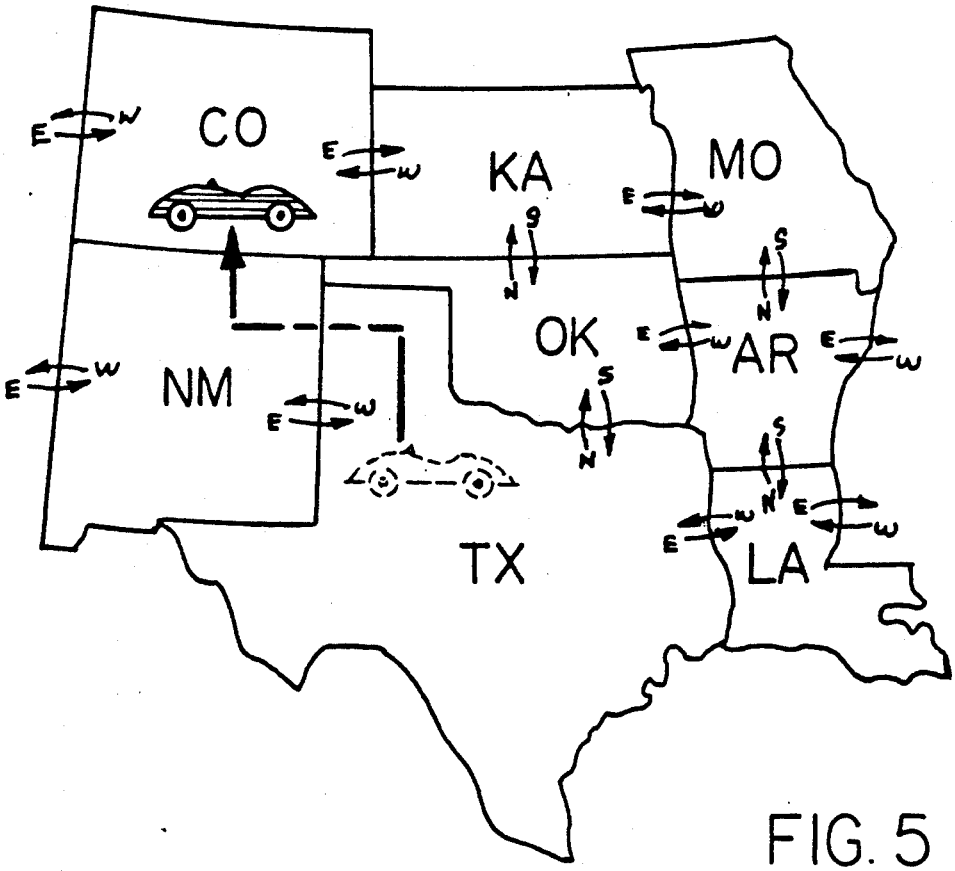
FIG. 5 illustrates the same view as FIG. 4 in which a game piece illustrated by an automobile has been moved according to a given roll of the dice.

FIGS. 4 and 5 graphically illustrate the movement of a game piece for a given roll of the dice. In FIG. 4 the game piece represented by a sports car 13 is positioned in Texas (TX). The player rolls W1 on the dice as illustrated in FIG. 4. In this instance as illustrated by the dotted lines of travel in FIG. 5, and new location of the game piece, the player has elected to move west into New Mexico (NM), and with the one free move, north into Colorado (CO).

There are certain instances where the roll of a dice may result in a player loosing his turn because the current location of the game piece does not allow for movement in the direction dictated by the dice. Assume for example that the game piece is positioned in Texas. The player then rolls SS on the dice. This provides only for movement south, and as shown on the map, because of the geographic location of Texas, no south movement is possible. In instances of this type, the player simply looses his turn. In other instances, it is possible that the player may only be able to use one move of one of the dice and must forfeit the other move. For example, if a player in California desires to go to Hawaii and rolls, a WW, he may use the first W move to get to Hawaii, and then looses his second W move, because there is no state to go to west of Hawaii.

The first player to pass through or land in all 50 states is declared the winner. If the player decides to play alone, he may as a standard see how few moves it takes to go through all 50 states, and compare those moves with playing the game at a later time.

It should be understood that the concept of the present invention, although illustrated for the United States, can also be adopted for any geographical region of the world such as Europe, Africa, South America, etc; or for that matter, the world as a whole. In this instance, the game board would be modified to simulate the geographical area or region of choice.

While the invention has been described in detail with respect to specific embodiments thereof, it will be understood by those skilled in the art that variations and modifications may be made without departing from the essential features thereof.

What is claimed is:

1. A game apparatus comprising in combination:

(a) a game board providing a playing area which simulates a map of the United States with each of the 50 states outlined and identified, and each of the states containing indicia for movement of a game piece in a north, south, east, or west direction in and out of a given state;

(b) a plurality of identifiable playing pieces which are intended to be moved from state to state;

(c) a pair of dice, each having six sides, respectively, and containing on each one of the six faces, respectively, identification of one of the four directions of the compass, or one of two numerals, each die having all four directions of the compass and both numerals identified thereon, and (d) with one game piece assigned to and moved by each individual player upon a roll of the dice in a north, south, east or west direction from state to state.

2. A game apparatus comprising in combination:

(a) a game board providing a playing area which simulates a map of a geographical area of the United States with each of the 50 states outlined and identified, and each of the states containing one or more pairs of directional arrows in a north-/south or east/west direction for travel of a game piece in and out of a given state;

(b) a plurality of identifiable playing pieces which are intended to be moved from state to state;

(c) a pair of dice, each having six sides, respectively, and containing on each one of the six faces, respectively, identification of one of the four directions of the compass, or the numerals 1 or 2, each die having all four directions of the compass and both numerals identified thereon, and (d) with one game piece assigned to and moved by each individual player upon a roll of the dice, in a north, south, east or west direction in response to the reading of the dice.

3. The game apparatus of claim 2 in which optional direction of movement is provided by the numerals 1 and 2 of the dice.

4. A game apparatus comprising in combination:

(a) a game board providing a playing area which simulates a map of a geographical area having a plurality of locations outlined and identified, with each of said locations containing indicia for movement of a game piece in a north, south, east or west direction;

(b) a plurality of identifiable playing pieces which are intended to be moved from location to location;

(c) a pair of dice, each having six sides, respectively, and containing on each one of the six faces, respectively, identification of one of the four directions of the compass, or one of two numerals, each die having all four directions of the compass and both numerals identified thereon, and (d) with one game piece assigned to and moved by each individual player upon a roll of the dice in a north, south, east or west direction from location to location.

5. The game apparatus of claim 4 in which optional direction of movement is provided by the numerals.

6. The game apparatus of claim 4 in which the numerals are respectively, 1 and 2.

* * * * *